United States Patent [19]

Roberts

[11] Patent Number: 4,919,712

[45] Date of Patent: Apr. 24, 1990

[54] METHOD AND APPARATUS FOR ADJUSTING ELECTRODE ISOTHERMS WITHIN ELECTRO-SLAG REMELTING

[75] Inventor: Raymond J. Roberts, West Berlin, N.J.

[73] Assignee: Consarc Corporation, Rancocas, N.J.

[21] Appl. No.: 351,757

[22] Filed: May 15, 1989

[51] Int. Cl.[5] ..... C22B 4/00

[52] U.S. Cl. ..... 75/10.24

[58] Field of Search ..... 75/10.24

[56] References Cited

U.S. PATENT DOCUMENTS 3,868,987 3/1975 Galey ..... 75/10.24

4,120,695 10/1978 Paton ..... 75/10.24

*Primary Examiner*—Peter D. Rosenberg

*Attorney, Agent, or Firm*—Seidel, Gonda, Lavorgna & Monaco

[57] ABSTRACT

A process and apparatus for electro-slag remelting including a cooling medium directed towards the electrode surface adjacent its entry into the slag layer. The cooling medium retards the melting of the electrode periphery within the slage so as to form a concave surface at the electrode tip, such that the molten metal from the electrode tip moves from the center of the electrode toward the outer periphery. The remelting of the electrode in this manner resulting in a shallower molten metal pool below the slag layer and a higher current density in the slag. The invention further redistributes the heat generated in the slag layer from the center towards the outer edge of the molten metal pool progressively formed within the mould and results in an improved smoothness on the surface of the ingot.

7 Claims, 2 Drawing Sheets

METHOD AND APPARATUS FOR ADJUSTING ELECTRODE ISOTHERMS WITHIN ELECTRO-SLAG REMELTING

BRIEF SUMMARY OF THE INVENTION

The present invention relates to electro-slag remelting of consumable electrodes to manufacture refined metal ingots having a pre-determined shape. In particular the invention relates to a method and apparatus for advantageously adjusting the isotherm shapes within the electrode in an electro-slag remelting operation.

BACKGROUND OF THE INVENTION

Electro-slag remelting (ESR) is a secondary refining process for metals. ESR is used for further purification of the metal after completion of the primary extraction and refining operations. ESR generally uses a raw material in the form of a solid consumable electrode which is either cast, wrought or composed of scrap. A layer of slag material contained in a cooled mould is resistance heated and melted by an electric current flowing between the electrode and a cooled base plate within the mould. As the temperature of the slag layer rises above the melting point of the metal, droplets melt off the tip of the electrode, fall through the slag and collect in a pool on the base plate. The pool of molten metal is cooled by the base plate and the mould walls and solidifies to form an ingot. The electrode is fed into the slag layer with the solidified ingot, which now acts as a secondary electrode, being progressively built up through further cooling.

Refinement within an ESR operation takes place because of a reaction between the metal and the slag during formation of droplets on the electrode tip. The detached droplets fall through the slag and collect in a pool at the top of the ingot. In most ESR operations it is preferred that the pool of molten metal be shallow. Such a condition produces a sound ingot that is free of porosity and pipe, as well as a high yield. An increase in current through the electrode typically increases the pool depth. An inadequate melt rate of the electrode produces an ingot having a rough, corrugated surface which results in a poor yield. A melt rate which is too high results in a large pool depth and increases porosity and pipe.

The ESR operation shown in U.S. Pat. No. 3,868,987 which is directed to an apparatus in which a liquid inert gas (e.g., argon or nitrogen) is placed on top of the molten slag. The liquified inert gas may be fed into the ingot mold by means of a single nozzle or by means of multiple nozzles via a manifold. The object of this structure is to isolate the slag and the electrode from the ambient atmosphere. Ambient air may act on the slag, introducing elements such as oxygen or hydrogen, which are then transferred by the slag to the purified metal. The layer of gas which is particularly inert with respect to the metal may be utilized to protect the slag from the ambient air and to a certain extent that which surmounts the slag.

U.S. Pat. No. 3,989,091 is directed to a method for electro-slag remelting of titanium or titanium alloys. This patent also discloses supplying a blanket of inert gas to the surface of the molten slag as well as supplying inert gas to the interface between the molten slag and the molten metal at the top of the ingot mould.

U.S. Pat. No. 4,120,695 is directed to an apparatus for controlling the melting .rate of a plurality of consumable electrodes which are simultaneously remelted. Because individual consumable electrodes may melt at different rates, a cooling gas is blown from a nozzle adjacent the electrode which is melting too quickly and, therefore, is immersed into the slag to a depth lesser than that of the other electrode. By cooling the electrode, its melting rate decreases and hence it becomes immersed more deeply into the slag, diminishing any unbalance in the melting of the electrodes.

SUMMARY OF THE INVENTION

The present invention relates to an ESR operation that advantageously modifies the melting of the electrode tip to produce a better ingot. The invention contemplates means to cool the surface of the electrode to modify the isotherms within the electrode and to modify the shape of the melting pattern at the electrode tip. This modification of the electrode isotherms and shape upon remelting enhances the refinement operation.

One embodiment of the present invention includes surrounding the electrode adjacent to the upper surface of the slag layer with a plenum or manifold that directs a cooling medium onto the electrode surface to reduce its surface temperature, and thus retard melting within the slag layer of the electrode periphery with respect to its center. The desired cooling rate will cause the electrode to melt off in a concave shape. Because of this melting pattern, the molten metal will tend to run across the surface of the electrode towards the outer periphery under the influence of gravity.

The present invention preferably decreases the heat input to the center of the ingot being formed while increasing the heat input near its outer edge. This result is obtained by the redistribution of the flow of molten metal from the electrode periphery, rather than from the center of the tip, and the formation of a relatively shallower molten metal pool. Additionally, the current distribution in the slag will be affected by the modified formation of the electrode tip. In the traditional ESR process, varying the distance between the electrode tip and the molten metal pool results in a current density in the central region of the slag which is higher than that in the peripheral region. The present invention effects a redistribution of the current and the associated heat generated in the slag from the center of the pool towards the outer edge. This redistribution beneficially assists the heat flow and, thus, ingot formation.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE PREFERRED EMBODIMENT

Figure 1:
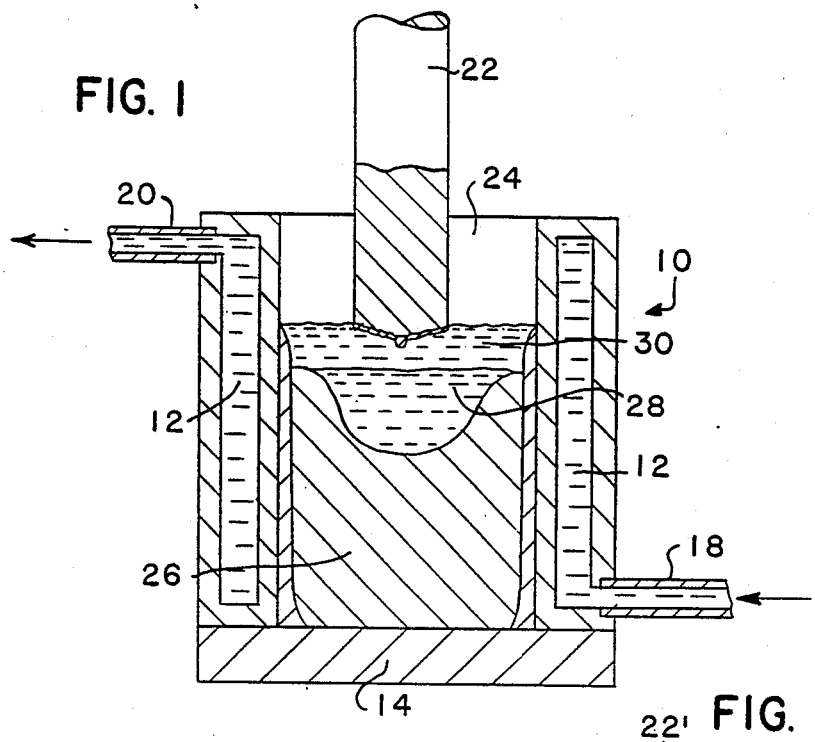
FIG. 1 shows a typical ESR apparatus in operation.

In the figures where like numerals indicate like elements there is shown an ESR refining apparatus having a mould 10 which is cooled by water circulation 12 and which rests on a base plate 14. The cooling water 12 is introduced into the side walls 16 of the mould 10 at input 18 and is exhausted from the mould 10 through output 20. Electrode 22 is inserted into a central upper opening 24 in the mould 10. Within the cavity defined by the mould 10 there is formed an ingot 26 having a molten metal pool 28 on its upper surface. Pool 28 is covered by a slag layer 30. The electrode 22 penetrates into the slag 30 and is positioned closely adjacent the upper surface of the pool 28.

Illustrated in FIG. 1 is a typical ESR operation as known in the art. The slag 30 is heated within the cooled mould 10 by an electric current flowing between the electrode 22 and the cooled base plate 14. (The source of the electric current is not shown.) As the temperature of the slag 30 rises above the melting point of the metal forming the electrode 22, droplets melt off the tip and fall through the slag 30 collecting in the pool 28 on the base plate 14. The pool 28 formed by the droplets solidifies due to the cooling of the mould 10. The electrode 22 is progressively fed into the cavity so that its end remains submerged with the slag 30. As the ingot 26 is progressively built up it will act as a secondary electrode to continue heating the slag 30.

In the embodiment shown in FIG. 1 the formation of the tip of the electrode 22 is somewhat convex or pointed. The metal melts off of the tip in the form of droplets which detach from the center of the convex surface and fall into the pool 28 on top of the growing ingot 26. The direction of the metal flow off the tip of the electrode 22 is influenced by gravity. The metal flows downhill towards the center or peak of the electrode tip.

A further effect of the pointed tip on the electrode is that the current density in the slag 30 is highest under the center of the electrode 22. This point is closer to the top of the ingot 26 than the outside edges of the electrode 22. Hence there is a shorter current flow path under the center of the electrode 22. This higher current density results in increased heating of the slag 30 under the center of the electrode 22 relative to the periphery. The increased heat generated in the slag 30 under the center of the electrode 22, combined with the flow of hot metal falling from the electrode tip, form a concentrated heat input to the center of the liquid metal pool 28. This helps retard the solidification of the center of the ingot 26, resulting in a liquid pool 28 which is relatively deep.

In FIGS. 2–5 there is shown the ESR operation as contemplated by the present invention. The electrode 22' in this preferred embodiment is surrounded by a plenum 32. Plenum 32 includes an input pipe 34 which feeds an annular chamber 36 having a series of nozzles 38 directed radially inward towards the periphery of the electrode 22'. Plenum 32 is positioned to direct a cooling medium, such as a gas, liquified gas or liquid, onto the electrode near the top of the slag layer 30. The flow of cooling medium is directed in such a manner so as to reduce the surface temperature of the electrode 22' and retard the melting rate of the portion of its periphery within the slag 30.

In the present invention the cooling medium provides a sufficiently intense surface cooling of the electrode 22', such that the isotherms therein are modified in a manner that is advantageous to the ESR process. The cooling medium is preferably directed onto the electrode 22' adjacent to the melting end, resulting in a reformation of the melting pattern of the electrode 22' as compared to the typical ESR operation shown in FIG. 1. As particularly illustrated in FIG. 3 the cooling of the surface of the electrode 22' retards melting of the periphery of the electrode tip and results in a melting pattern having a concave shape. As the metal melts, the curvature of the concave shape tends to direct the molten metal on the electrode tip towards the outer periphery of the electrode 22'.

An intense surface cooling of the electrode 22' to modify the isotherms therein in the manner desired is achieved by flowing the cooling medium with respect to the electrode at a flow rate in excess of approximately 100 feet per minute at the electrode surface. The upper limit of this gas flow rate would be a matter of degree depending upon the parameters of the ESR process. However, faster flow rates would result in a diminishing return at certain levels depending on the parameters of the ESR operation. In any event, selection of flow rates to achieve the intense surface cooling is contemplated to be within the level of skill in the art.

Figure 5:
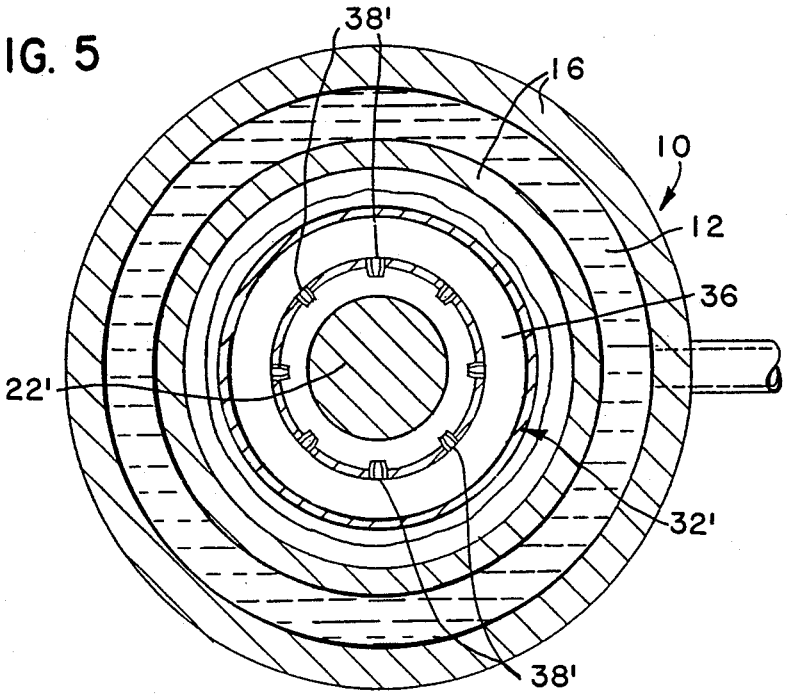
FIG. 5 is an alternate embodiment of the portion of the apparatus illustrated in FIG. 4.

An alternate embodiment of the cooling means is shown in FIG. 5. The plenum 32' includes directional nozzle jets 38'. Jets 38' are contemplated to produce a more powerful stream of the cooling medium towards the surface of the electrode 22' to further enhance the cooling effect on the periphery of the electrode 22'. These jets 38' are contemplated to direct a flow of gas at a faster rate than that contemplated by nozzles 38 illustrated in FIG. 4.

Figure 3:
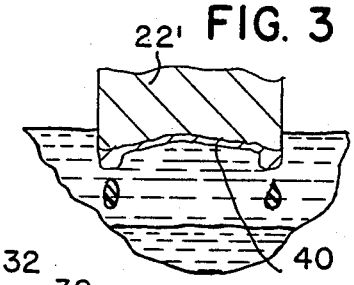
FIG. 3 is an enlarged view of the electrode tip as contemplated by the present invention.
Figure 2:
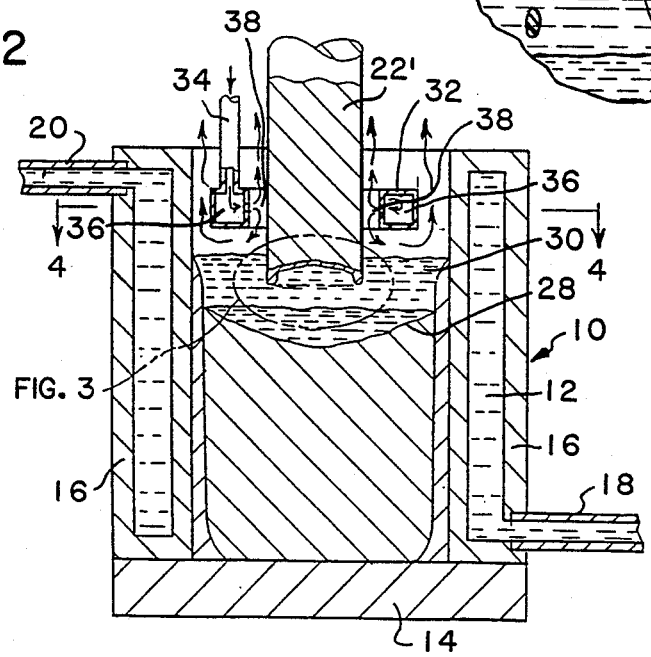
FIG. 2 shows one embodiment of the present invention.
Figure 4:
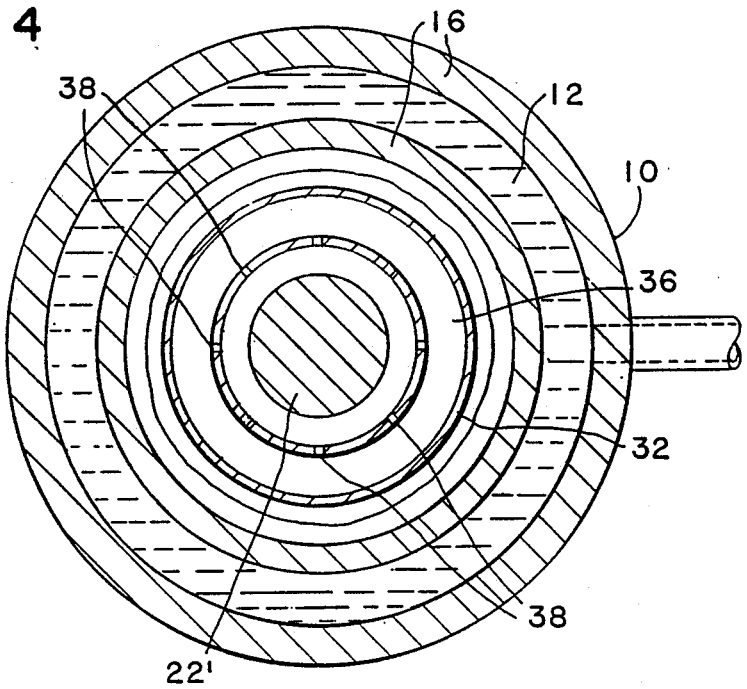
FIG. 4 is a cross sectional view of the apparatus shown in FIG. 2 as taken along line 4—4.

An additional advantage is achieved by reshaping of the electrode tip. The current concentration under the center of the electrode 22 in the conventional process (FIG. 1) has been repositioned to the area under the periphery of the electrode 22' (FIGS. 2 and 3). Therefore, the central heat concentration in the slag 30 of the conventional process has been removed. The reduced heat input to the slag 30' and the absence of metal flow into the top of the ingot 26' at the center in the improved process combine to effect a reduction in the heat input to the center of he liquid pool 28'. As a result, the metal pool 28' of the improved process is significantly shallower than that of the conventional process.

A shallower pool may be used as a means to produce an ingot 26' of superior quality to the conventional process. Alternatively, the improved process may be used at an increased melt rate to produce an ingot having the same pool depth and quality as the conventional process. Such an increased melt rate improves the throughput and decreases the specific power consumption of the improved process.

In some cases, ingots are produced at the lowest possible melt rate in order to achieve the shallowest possible liquid metal pool and highest quality. In these cases, reduction of melt rate below a particular level is prevented because of deterioration of the ingot surface. This deterioration is caused when the outer periphery of the top of the ingot starts to solidify inwardly and away from the mold walls. As liquid metal is added to the center of the ingot, the level of the liquid metal becomes higher than that of the solid, with the liquid metal supported by surface tension. When more liquid metal has been added than can be supported by surface tension forces the metal flows outward across the top of the solid ingot periphery, then freezes as it approaches the crucible wall. This process repeats itself, forming an ingot having a rough, corrugated surface with deep cold shuts. Such an ingot, if it is to be used at all, requires expensive surface conditioning.

With the improved process, the tendency toward inward freezing of the upper surface of the ingot is reduced by the redistributed heat pattern. In particular, the additional heat input to the peripheral regions of the top of the ingot of the improved process resulting from the metal falling from the outer periphery of the electrode, together with the increased heat input to the slag in this region, not only acts to lower the temperatures in the center of the process but also to raise the temperatures in the peripheral region. This allows smooth surfaced ingots to be advantageously made at melt rates lower than that possible in the conventional process.

The present invention may be embodied in other specific forms without departing from the spirit or essential attributes thereof and, accordingly, reference should be made to the appended claims, rather than to the foregoing specifications, as indicating the scope of the invention.

I claim:

1. A method of electro-slag remelting comprising the steps of:

providing a consumable electrode, establishing a slag layer in a mold cavity, resistance heating the slag layer by passing an electric current between the electrode and the base of the mold cavity, immersing one end of the electrode into the slag layer, progressively melting the end of the electrode and forming a molten metal pool in the mold cavity under the slag layer, cooling the mold cavity to continuously solidify the molten metal pool, and controlling the melting pattern of the electrode by intensely cooling the circumferentially exposed surface of the electrode adjacent its immersion into the slag layer such that the end of the electrode immersed in the slag layer is caused to maintain a concave shape during said progressive melting.

2. A method of electro-slag refining comprising the steps of:

providing a consumable electrode, establishing a slag layer in a mold cavity, immersing one end of the electrode into the slag layer, progressively melting the immersed end of the electrode and forming a molten metal pool in the mold cavity under the slag, directing a cooling medium by placing a plurality of nozzles around the electrode to produce an intense stream of said cooling medium onto the exposed surface of the consumable electrode adjacent the upper surface of the slag layer, altering the temperature isotherms within the electrode adjacent the immersed end while retarding the melting pattern of the periphery of the electrode tip with respect to the center of the tip, resulting in a flow of molten metal substantially from the electrode periphery into the molten metal pool, and progressively cooling the molten metal pool to form a refined metal within the cavity.

3. An apparatus for electro-slag refining of a consumable electrode comprising:

a mold having side walls, a base and an open upper end, the mold defining a cavity therein, means for cooling the side walls and base of the mold, means for providing a slag layer within the mold, means for progressively inserting the electrode into the mold and the slag layer, means for resistance heating the slag layer to a temperature above the melting temperature of the electrode, and means for controlling the melting pattern of the portion of the electrode in the slag layer by surrounding the electrode by a cooling medium and directing said cooling medium in an intense manner onto the exposed peripheral surfaces of the electrode adjacent to its insertion into the slag layer, at a velocity in excess of 100 feet per minute in a gas cooling medium, thus retarding the melting of the periphery of the electrode tip, wherein the melting pattern of the electrode tip results in a greater current density in the slag under the periphery of the electrode tip relative to the current density under the center of the electrode tip and a flow of molten metal substantially from the center of the tip toward the periphery and into a metal pool formed below the slag layer.

4. An apparatus as claimed in claim 3 wherein the cooling medium is either a gas, liquified gas or liquid.

5. An apparatus as claimed in claim 3 wherein the cooling means further comprises a plenum surrounding the electrode and having a series of nozzles directing the cooling medium radially inward toward the peripheral surfaces of the electrode 6. An apparatus as claimed in claim 5 wherein the nozzles include directional jets.

7. An apparatus for electro-slag remelting of a consumable electrode for refining purposes, comprising:

a mold having side walls, a base and defining an open cavity therein, means for cooling the side walls and base of the mold, means for providing a slag layer within the mold cavity, means for progressively immersing the electrode tip into the slag layer within the mold, means for providing an electric current between the electrode and the base of the mold and for resistance heating the slag layer to a temperature great enough to melt the immersed tip of the electrode, and means for directing a cooling medium by placing a plurality of nozzles around the electrode to produce an intense stream onto the exposed surfaces of the electrode adjacent the upper surface of the slag layer, said directing means adapted to alter the temperature isotherms within the electrode and retard the melting of the periphery of the electrode tip with respect to the center of the tip, resulting in a flow of molten metal from the center of the electrode, the molten meal falling off the periphery of the electrode tip and passing through the slag layer to continuously form a molten metal pool within the mold cavity.

* * * * *